United States Patent [19]

Ingram

[11] 4,437,813

[45] Mar. 20, 1984

[54] GAS RECEIVING AND TRANSMITTING SYSTEM

[75] Inventor: Walter B. Ingram, Hagerstown, Md.

[73] Assignee: Frick Company, Waynesboro, Pa.

[21] Appl. No.: 374,820

[22] Filed: May 4, 1982

[51] Int. Cl.[3] ..... F04B 17/00

[52] U.S. Cl. ..... 417/53; 417/364; 60/39.465; 60/39.181; 418/DIG. 1; 55/171; 55/200; 55/DIG. 17; 123/527; 62/473

[58] Field of Search ..... 417/364, 53; 60/39.465, 60/39.181; 418/DIG. 1; 55/171, 182, 200, DIG. 17; 123/196 AB, 527, DIG. 12; 62/473

[56] References Cited

U.S. PATENT DOCUMENTS

| | | | |
|---|---|---|---|
| 3,104,524 | 9/1963 | Flanders | 60/39.161 |
| 3,370,636 | 2/1968 | Francis et al. | 55/171 X |
| 3,525,218 | 8/1970 | Buss | 60/39.511 X |
| 3,785,755 | 1/1974 | Novak et al. | 418/55 |
| 3,945,464 | 3/1976 | Sato | 417/228 X |

*Primary Examiner*—Richard E. Gluck
*Attorney, Agent, or Firm*—Dowell & Dowell

[57] ABSTRACT

A compressor that uses an excess of lubricant for sealing and cooling is driven by a natural gas engine and pumps natural gas to a transmission outlet, the lubricant drawing off moisture from the gas and portion then being pumped through a circuit in which moisture is removed after which the lubricant is returned to the compressor.

17 Claims, 2 Drawing Figures

VAC P
CK V

GAS RECEIVING AND TRANSMITTING SYSTEM

BACKGROUND OF THE INVENTION

This invention relates to the gathering or receiving and pumping of natural gas in its raw state from wells and from sources fed by wells to a transmission line or other point of use.

Heretofore the pumping or compressing has ordinarily been done by reciprocating compressors due to the problem of moisture and other contaminants in the raw gas. The use of compressors that employ an excess of lubricant for sealing and cooling has apparently not been feasible because of the problem of the moisture contaminating the lubricant. Thus various advantages inherent in the use of a rotary compressor of the oil injection type have not been possible in the pumping of raw gas due to the contamination problem.

FIELD OF THE INVENTION

The present invention relates to the pumping of fluids particularly natural gas in which the gas provides the energy for the compressor and in which moisture is removed from the oil continuously, and also from the gas.

BACKGROUND ART

Compressors that employ an excess of lubricant for sealing and cooling are known in the art. These may include the screw type as referred to generally in the patent to Bulkley U.S. Pat. No. 3,856,493, the sliding vane type as in the Sato U.S. Pat. No. 3,945,464, and the Nash-Hytor type as disclosed in the U.S. Pat. to Lowther No. 3,994,074. In Lowther, sulphuric acid is used to remove water from a gas stream, the sulphuric acid being regenerated by an electrolytic process. Another U.S. patent illustrative of the art is Novak et al. No. 3,785,755.

The above patents also disclose various means of separating the oil from other components of the compressor discharge stream in order that the oil may be in satisfactory condition for recirculation through the compressor.

Wymer U.S. Pat. No. 4,279,628 discloses the use of triethylene glycol for mixing with water in a gas stream and subsequent separation of the water by centrifugal action.

Brown U.S. Pat. No. 3,234,879 discloses a vacuum pump which utilizes a single screw submerged in water with the vortex action producing vacuum. Lubricants are not involved and water in the gas is separated by gravity. Brown also discloses pumping natural gas and using a portion of it as fuel for the engine that drives the pump.

The use of turbines for pumping natural gas in which a portion is used as fuel is disclosed in various patents including U.S. Pat. Nos. Flanders 3,104,524, Fono 3,107,482, Buss 3,525,218, and Fomichev 4,273,508.

SUMMARY OF THE INVENTION

The invention includes a compressor that uses an excess of lubricant for sealing and cooling and that is arranged to pump a fluid, a portion of which powers the engine that drives the compressor, the compressed gas and the compressed fluid with the lubricant being discharged into a separator from which the gas is transmitted to a point of use, the mixed oil and moisture being recirculated back to the compressor, a portion thereof being diverted in heat exchange relation with coolant from the engine and then placed under reduced pressure in order to remove the moisture, the moisture free oil then being recirculated back to the compressor.

DESCRIPTION OF THE PREFERRED EMBODIMENT

Figures 1, 2:
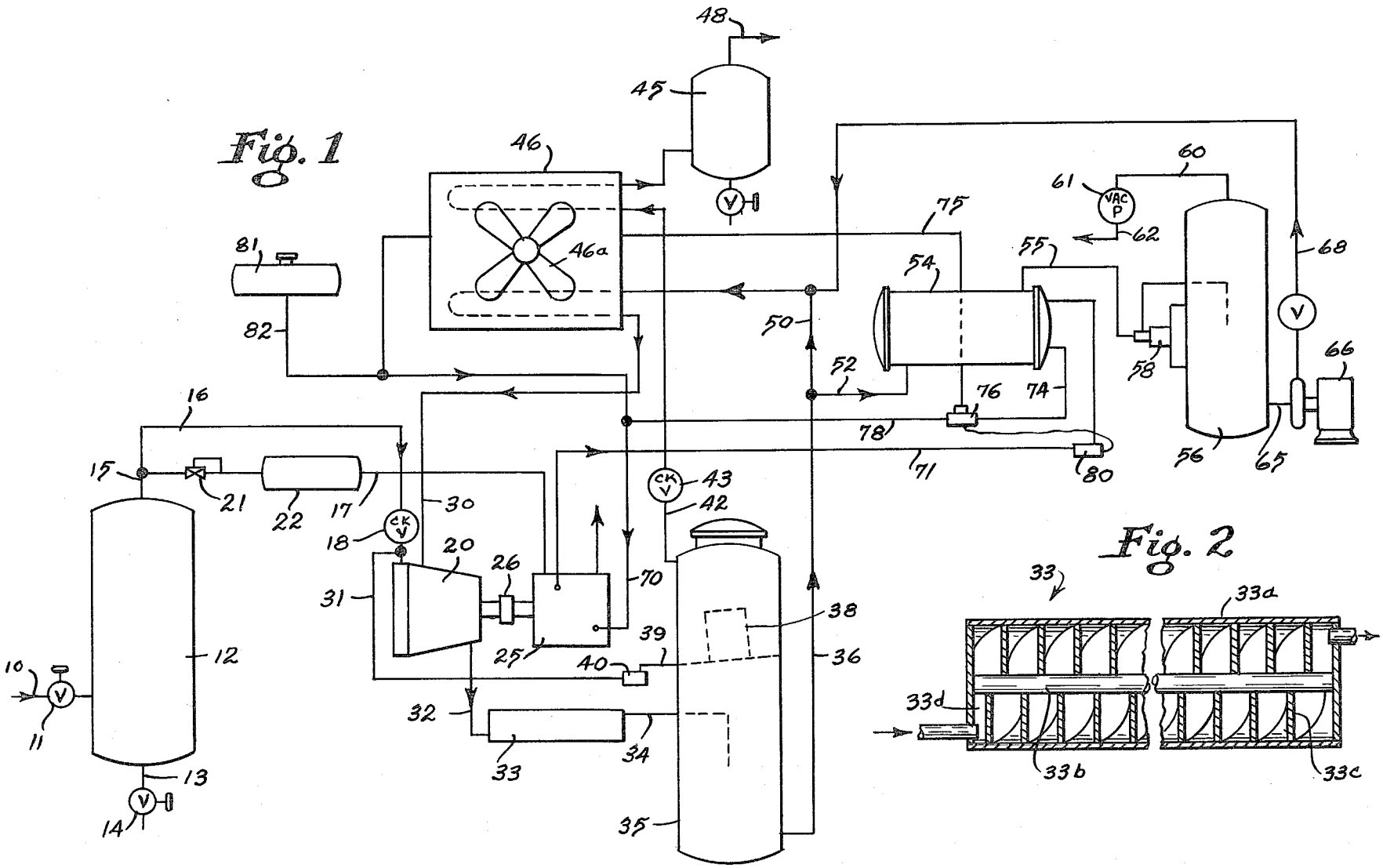
FIG. 1 is a schematic layout of a system embodying the invention.
FIG. 2 is an enlarged section of the swirl tube.

With further reference to the drawings a supply pipe 10 having gate valve 11 feeds natural or raw gas into separator 12. The gas is obtained from a well or other source and ordinarily is at a pressure of from two to fifteen pounds per square inch gauge. Raw gas commonly has contaminants such as moisture and may include droplets of water and hydrocarbons. In the separator 12 such liquid contaminants are collected and may be drained from time to time through outlet 13 having valve 14.

At the top of the separator 12 there is an outlet pipe 15 having a primary conduit 16 and a secondary branch 17. Conduit 16 has a one-way valve 18 to the inlet of compressor 20.

Branch line 17 includes a pressure regulating valve 21 and pulsation damper 22 to an internal combustion engine 25 under control of a conventional gas engine governor system, not shown. Engine 25 drives compressor 20 through conventional coupling 26.

The compressor receives lubricant through inlet pipes 30 and 31 and discharges gas under pressure having some lubricant entrained therewith through outlet pipe 32. Pipe 32 is connected to swirl tube 33 which tends to throw the lubricant and water outwardly to promote mixing thereof, the gas thus tending to separate from the oil and water in the tube. From the tube an outlet pipe 34 discharges into oil separator 35.

The swirl tube 33 is illustrated in more detail in FIG. 2. It includes an outer shell **33*a*, a center mandrel or shell 33*b* and a plurality of spaced fins 33*c* which are wrapped on edge in a helical manner between the mandrel and the outer shell, thereby providing separated flow channels 33*d*** through the tube. The proportions of the tube may vary depending upon the size of the system. An example is a tube approximately 50" (127 cm) in length and having a diameter of 6" (15.2 cm) and 12 fins. The arrangement causes continuous rotation of the flowing gaseous materials between the outer shell and inner mandrel.

The lubricant is preferably a synthetic oil, well known in the art, which is miscible with water in order that moisture may be more effectively removed from the gas. However, a conventional mineral oil lubricant may be used due to the fact that the means for separating water from oil, to be described later, is effective with either type of oil. A preferred lubricant for example is polyglycol based. This lubricant is not miscible in hydrocarbons so that any hydrocarbon liquids that are present will separate and float on the surface in the separator 35. Water on the other hand is miscible in the lubricant and will go into solution. Since the lubricant has affinity for water it will tend to dry the gas.

Within the oil separator 35 the relatively dense oil and entrained water collects in its lower portion for discharge through an outlet pipe 36. A minor portion of the oil in vaporous or lighter form is drawn into a coalescent filter element 38 located in the upper portion of the oil separator housing 35 and drains to outlet conduit 39 and trap 40 to return line 31 to the compressor.

The gas in the oil separator discharges through line 42 having a one-way valve 43 therein and into final separator 45 after passing through air cooled heat exchanger 46. The gas discharging from final separator 45 through conduit 48 has been further reduced in moisture content to the extent that water, initially carried with the gas, has mixed with the oil and been removed.

The oil and water mixture leaving the oil separator through pipe 36 has a major portion, which may be approximately 90%, returned to the compressor via line 50 which passes through the air cooled heat exchanger 46 and to inlet pipe 30 to the compressor.

A branch line 52 from line 36 diverts a portion of the oil and water, say about 10%, into an oil heater 54 from which it is discharged to line 55 into oil dehydrator 56, the level in which is controlled by conventional means such as float control 58. The oil dehydrator is connected at the top to line 60 to a vacuum pump 61 which applies approximately 25 inches of mercury vacuum within the oil dehydrator thereby causing the water in the oil to boil off and be discharged through outlet 62. The moisture free oil is drawn through pipe 65 by pump 66 and is delivered by conduit 68 to the return line 30 back to the compressor 20.

The engine 25 has a cooling water system with inlet 70 and discharge 71 to the oil heater 54 in order to heat the oil by heat exchange for purposes described. From the oil heater the cooled water exits into line 74 for return to the engine through line 75 and line 70, line 70 passing through air cooled heat exchanger 46. Valve 76 between lines 74 and 75 may divert varying amounts of water to line 78 back to line 70, said valve being controlled by temperature responsive element 80 in line 71 in order that the temperature in the oil heater 54 may be maintained at a proper level.

The proportion of the oil and water mixture that is diverted through line 52 is governed primarily by the capacity and operation of pump 66. It has been found that a diversion of approximately 10% with removal of water therefrom is sufficient to maintain the quality of the oil but this proportion may be varied depending upon desired conditions by means well known in the art.

Water makeup and expansion to line 70 is provided by tank 81 connected by line 82 to line 70.

At the start-up of operation the speed of the engine 25 is set to a rate to accommodate the available gas flow, such rate being controlled by the conventional governor system.

Similarly, the rate of operation of the air cooling fan 46*a* for the heat exchanger 46, the pump 66 and the vacuum pump 61 are set at appropriate rates and interlocked for operation during operation of the engine 25. Thus for a fixed gas flow rate the internal control of the system is automatic. Automatic override of the engine speed, within fixed limits, may be provided when the amount of gas supply is variable. Appropriately safety relief and shutdown elements, well known in the art, may also be provided.

In operation, as applied to a flow of natural raw gas, the gas from line 10 and initial separator 12 passes through lines 15 and 16 into compressor 20 from which it flows together with oil from line 30 into oil separator 35, the oil having mixed with moisture in the gas, especially in swirl tube 33. The compressed and relative moisture free gas is discharged through line 42 through heat exchanger 46 and line 48. Oil vapors which collect in filter element 38 drain into line 39 for return to the compressor. The oil with water mixed therein passes through lines 36 and 50 to heat exchanger 46 and is returned to the compressor by line 30. Since a certain amount of moisture in the oil is desirable or tolerable for compressor operation, only a portion of the oil mixture from the oil separator 35 is diverted for removal of the moisture. This diverted oil water mixture is passed through line 52 through heater 54 and line 55 into the oil dehydrator 56. In the dehydrator the pressure is lowered sufficiently to vaporize moisture from the oil by vacuum pump 61 which draws the water vapor out of the dehydrator 56. The oil in the lower portion of the dehydrator is withdrawn by pump 66 which is sized and operated at a rate to divert the predetermined proportion of the oil and water mixture from line 36. The pump causes the moisture free oil to flow through line 68 and back to line 30.

The compressor is driven by engine 25 powered by gas running through lines 15 and 17. Coolant from the engine is supplied through line 71 to heater 54, the return flow being controlled by valve 76 and sensor 80 to maintain a desired temperature of coolant.

I claim:

1. A system for receiving relatively high moisture content raw gas from a location and pumping it in a relatively dry condition to an outlet, comprising an oil injection type rotary compressor, an internal combustion engine connected to drive said compressor, first pipe means for carrying said raw gas to the inlet of said compressor, second pipe means for carrying raw gas to said engine, third pipe means for carrying oil to said compressor, fourth pipe means leading from said compressor to a separator housing, means in said fourth pipe means for intermingling the fluids discharged from said compressor, means in said separator housing for separating the gas from the oil and water mixture, means for discharging dry gas from the upper portion of said separator housing, discharge means from the lower portion of said housing for the mixture of oil and water, means for returning a predetermined major portion of said oil and water mixture to the third pipe means to said compressor, means for diverting the remainder of said oil and water mixture, heat exchange means between said means for diverting the remainder and said engine thereby raising the temperature of said diverted remainder of said oil and water mixture, a dehydrator housing, means carrying said diverted remainder to said dehydrator housing, pump means for drawing liquid from the lower portion of said dehydrator housing, means connected to the upper portion of said dehydrator housing for creating a vacuum therein whereby water vapor is removed from the oil and drawn off from said dehydrator housing, and means for returning the water-free oil from said pump means of said dehydrator housing to said third pipe means to said compressor.

2. A system for receiving relatively high moisture fluid from a location and pumping it in a relatively dry condition to an outlet, comprising a lubricant sealed compressor, first pipe means for carrying said fluid to the inlet of said compressor, second pipe means for carrying lubricant to said compressor, third pipe means from the outlet of said compressor to lubricant separator means, said separator means separating the fluid from the lubricant and water mixture, first discharge means from said lubricant separator means for said fluid, second discharge means from said lubricant separator means for the mixture of lubricant and water, means for returning a portion of said lubricant and water mixture to the second pipe means to said compressor, means for diverting the remainder of said lubricant and water mixture to lubricant dehydrator means, pump means for drawing lubricant from said lubricant dehydrator means, said lubricant dehydrator means having means for lowering the pressure and for removing water vapor from the lubricant, and means for returning the relatively water-free lubricant from said pump means to the second pipe means to said compressor.

3. The invention of claim 2, and heat evolving power means driving said compressor, and heater means for raising the temperature of said diverted lubricant and water mixture.

4. The invention of claim 3 in which a coolant circulates between said power means and said heater means for raising the temperature of said mixture.

5. The invention of claim 3, in which said heat evolving power means is powered by a portion of said relatively high moisture fluid.

6. The invention of claim 2, in which said pump means controls the proportionate amount of the lubricant and water mixture that is diverted.

7. The invention of claim 4, in which means is provided for cooling the lubricant returning to said compressor and means for further cooling said coolant after it exchanges heat with said diverted remainder of said lubricant.

8. The invention of claim 2, said lubricant separator having means for trapping vaporous lubricant, and means for collecting and returning said trapped lubricant to said compressor.

9. The invention of claim 2, said third pipe means having tube means for intermingling the fluid and lubricant discharged from said compressor.

10. The invention of claim 9, said tube means having internal flow directing means to cause helical movement of said fluid and lubricant thereby producing centrifugal forces tending to cause said lubricant and the water in the fluid to flow outwardly toward the inner periphery of said tube means thereby promoting mixing of the lubricant and the water.

11. The invention of claim 7, and means for bypassing a portion of said coolant around said further cooling means in response to the temperature of said coolant sensed at said heater means, and means for sensing the temperature of said coolant at said heater means.

12. The invention of claim 11, in which the temperature sensing means senses the temperature of the coolant entering said heater means.

13. The method of collecting and transmitting natural gas flow having significant moisture present, comprising using a portion of said gas flow to power an engine of the type that evolves heat, using the engine to drive a compressor that uses a surplus of lubricant for sealing and cooling, compressing the remainder of said gas flow in said compressor, injecting a lubricant into said compressor, intimately mixing said lubricant with the gas in order that the lubricant will mix with the water in the gas, separating the lubricant and water mixture from the gas, discharging the compressed relatively moisture free gas, returning a predetermined portion of the lubricant and water mixture to the compressor, diverting the remainder of the mixture in heat exchange relations with the engine to elevate the temperature of the mixture, lowering the pressure of the mixture sufficiently to vaporize the water, withdrawing the water vapor, and pumping the remaining lubricant back to the compressor.

14. The method of claim 13 in which the lubricant is the type that is relatively miscible with water but not miscible with hydrocarbons.

15. The method of claim 13 in which the engine has a coolant flowing in a cooling system and the coolant flows in heat exchange relation with the diverted mixture of lubricant and water, and sensing the temperature of the coolant before it passes in heat exchange relation with the diverted mixture, and further cooling a portion of the coolant after said heat exchange relation, such portion being determined in response to the said sensed temperature of the coolant.

16. The method of claim 13 in which the lubricant is pumped back to the compressor at a predetermined rate to control the portion of the mixture that is diverted.

17. The method of claim 13 in which the lubricant is intimately mixed with the gas after compression by subjecting them to centrifugal force so that the lubricant and water will mix more intimately.

* * * * *